US007289072B2

(12) United States Patent
Sakurai

(10) Patent No.: US 7,289,072 B2
(45) Date of Patent: Oct. 30, 2007

(54) MOBILE WIRELESS TERMINAL

(75) Inventor: Masanori Sakurai, Tokyo (JP)

(73) Assignee: Nec Corporation, Tokyo (JP)

( * ) Notice: Subject to any disclaimer, the term of this patent is extended or adjusted under 35 U.S.C. 154(b) by 63 days.

(21) Appl. No.: 11/260,320

(22) Filed: Oct. 28, 2005

(65) Prior Publication Data

US 2006/0092084 A1 May 4, 2006

(30) Foreign Application Priority Data

Oct. 29, 2004 (JP) ..... 2004-316602

(51) Int. Cl.
*H01Q 1/24* (2006.01)

(52) U.S. Cl. ..... 343/702

(58) Field of Classification Search ..... 343/700 MS, 343/702, 846

See application file for complete search history.

(56) References Cited

U.S. PATENT DOCUMENTS 6,995,719 B2 * 2/2006 Ide ..... 343/702
7,009,567 B2 * 3/2006 Iwai et al. ..... 343/702

FOREIGN PATENT DOCUMENTS

| | | | |
|---|---|---|---|
| EP | 1 445 821 | | 8/2004 |
| EP | 1 538 694 | | 6/2005 |
| JP | 2002-246822 | A | 8/2002 |
| JP | 2003-008320 | A | 1/2003 |
| JP | 2003-037413 | A | 2/2003 |
| JP | 2004-134975 | A | 4/2004 |
| JP | 2004-172919 | A | 6/2004 |
| WO | 2004/010530 | | 1/2004 |
| WO | 2004/025778 | | 3/2004 |

* cited by examiner

*Primary Examiner*—Hoang V. Nguyen
(74) *Attorney, Agent, or Firm*—Sughrue Mion Pllc.

(57) ABSTRACT

There is provided a mobile wireless terminal in which characteristics such as improved antenna directivity of a built-in antenna and gains thereof are improved and downsizing is possible. The mobile wireless terminal comprises: an electrically conductive upper housing which contains an upper board; a lower housing which contains a lower board; and a hinge part which connects the upper housing and the lower housing to each other. An antenna element and an auxiliary metal fitting (a parasitic element) which are provided on the lower board are opposed to each other such that the antenna element and the auxiliary metal fitting each are electrostatically capacity-coupled with the upper housing by the hinge part. The auxiliary metal fitting and the antenna element are capable of changing the directivity since the auxiliary metal fitting and the antenna element are provided close to a part of the upper housing. As a result, antenna characteristics can be improved without sacrificing the design of outer appearance.

16 Claims, 8 Drawing Sheets

ANTENNA ELEMENT

AZIMUTH PATTERN GAIN DISPLAY(dBi)

ANTENNA ELEMENT + PARASITIC ELEMENT

AZIMUTH PATTERN GAIN DISPLAY(dBi)

CROSS-SECTION A-A

6: ANTENNA ELEMENT
8: PARASITIC ELEMENT

CROSS-SECTION B-B

ANTENNA ELEMENT

ANTENNA ELEMENT + PARASITIC ELEMENT

ANTENNA ELEMENT

AZIMUTH PATTERN GAIN DISPLAY(dBi)

ANTENNA ELEMENT + PARASITIC ELEMENT

AZIMUTH PATTERN GAIN DISPLAY(dBi)

MOBILE WIRELESS TERMINAL

BACKGROUND OF THE INVENTION

1. Field of the Invention

The present invention relates to a mobile wireless terminal and particularly to mobile wireless terminal such as a cellular phone having a built-in antenna.

2. Description of the Related Art

Conventionally, a cellular phone as a typical mobile wireless terminal frequently uses a whip antenna or fixed coil antenna which can be pulled up or is storable. However, because of recent downsizing of cellular phones and inclusion of antennas inside casings, it is indispensable for design of an antenna to take into consideration design of a casing.

A known method of changing directivity of an antenna of a mobile wireless terminal is a method in which a parasitic element is provided near a feeding part of an antenna element (see JP-A-2003-037413).

In a mobile wireless terminal having a downsized/built-in antenna, the antenna characteristics tend to deteriorate. In addition, the antenna characteristics are easily influenced by human bodies. Problems of deterioration in characteristics, gain loss, and the like hence have arisen. Directivity of an antenna is therefore difficult to improve without sacrificing designs of the outer appearance.

SUMMARY OF THE INVENTION

An object of the present invention is to provide a mobile wireless terminal which enables an antenna to be downsized and built in without deterioration of characteristics of the antenna.

Another object of the present invention is to provide a mobile wireless terminal which enables improvements of characteristics of the antenna of a mobile wireless terminal having a built-in antenna, such as directivity, gain, and the like of the antenna.

A mobile wireless terminal according to the present invention relates to a mobile wireless terminal comprising: an electrically conductive upper housing which contains an upper (circuit) board; a lower housing which contains a lower (circuit) board; a connection part which connects the upper and lower housings to each other; and an antenna element and a parasitic element (an auxiliary metal fitting) which are provided in the lower housing, the antenna element and the parasitic element being opposed to each other such that the antenna element and the parasitic element each are capacity-coupled with the upper housing, by floating capacity, at the connecting part.

The auxiliary metal fitting in the connecting part is provided at a position opposed (symmetrical) to the antenna element, close to a part of the upper housing. In this way, directivity is changed to improve antenna characteristics without sacrificing design of the outer appearance.

More specifically, the connection part is constructed as a hinge part which allows the upper and lower housings to be folded. In these foldable housings, the circuit boards are provided respectively. The antenna element and auxiliary metal fitting are provided on the circuit board in the lower housing or the like. Each of the antenna element and auxiliary metal fitting is situated near a part of the upper housing, to improve the antenna characteristics. The auxiliary metal fitting is a parasitic element supplied with no high-frequency signal. On the circuit board or the like connected with the auxiliary metal fitting, the auxiliary metal fitting is connected or open to the ground, and is provided at a position near the upper housing, which is different from the nearby area of the antenna element or a feeding point thereof, thereby to change the directivity. Thus, the antenna characteristics are improved.

That is, according to an aspect of the present invention, there is provided a mobile wireless terminal comprising: an electrically conductive upper housing which contains an upper board; a lower housing which contains a lower board; and a connection part which connects the upper and lower housings to each other, wherein an antenna element and a parasitic element which are provided in the lower housing are opposed to each other near the connection part such that the antenna element and the parasitic element each are capacity-coupled with the upper housing, inside the lower housing. The connection part may be constructed as a hinge part which allows the upper and lower housings to be folded.

The lower housing may be constituted by a front cover and a rear cover, and the antenna element and the parasitic element may be provided in the rear cover. Either a front cover or a rear cover of the upper housing may have two cylindrical protrusions which are hinged to the lower housing. At least one of the front cover and the rear cover of the upper housing may be electrically conductive.

Further, the two cylindrical protrusions may be electrically conductive, and may be electrically connected to the at least electrically conductive one of the front cover and rear cover of the upper housing. The antenna element and the parasitic element may be provided at positions near the two cylindrical protrusions, respectively.

Further, the antenna element and the parasitic element may have ends opposed to each other in the connection part, and situated in parallel with the hinge axis of the hinge part. The lower housing may be made of a nonconductive material.

According to the present invention, the parasitic element is provided at a position different from the position of the antenna element, in the connection part connecting the upper and lower housings. The electrically conductive upper housing and the parasitic element are situated close to each other to capacity-couple the parasitic element and the upper housing. In this way, the current flow in the upper housing can be changed. Therefore, directivity can be changed to improve antenna characteristics. It is thus possible to maintain excellent communication quality.

Both of the antenna element and the parasitic element are provided in a small space in the connection part or particularly in the upper end of the rear cover of the lower housing. Therefore, any protrusion need not be provided on surfaces of the housings. Accordingly, the antenna characteristics can be improved without sacrificing design of the outer appearance of the mobile wireless terminal.

In place of capacity-coupling directly the antenna element and the parasitic element with the electrically conductive upper housing, the present invention may adopt a structure in which capacity-coupling is achieved through two electrically conductive cylindrical protrusions which are provided on one of the front and rear covers of the upper housing and are hinged to the lower housing. As a result, the coupling capacity can be increased so that sufficient increase in gain and improvements in directivity can be achieved.

Further, one kind or a combination of various kinds of elements, such as rod-like, plate-metal-like, inverted-F-shaped, and F-shaped elements, can be used for the antenna element and the parasitic element. The parasitic element can have an open end or grounded end. This allows the antenna characteristics to be changed or adjusted.

BRIEF DESCRIPTION OF THE DRAWINGS

In the accompanying drawings:

FIGS. 4A and 4B are graphs showing general tendencies of antenna directivity of the mobile wireless terminal shown in FIGS. 1 and 2, wherein FIG. 4A shows directivity of the antenna shown in FIG. 1 and FIG. 4B shows directivity of the antenna shown in FIGS. 2 and FIG. 3;

FIGS. 7A to 7C are cross-sections and a rear view near the hinge part, including an antenna element and a parasitic element, with the rear cover excluded, wherein FIG. 7C is a rear view near the hinge part, FIG. 7A is a A-A cross-section at a position where the antenna element is provided, and FIG. 7B is a B-B cross-section at a position where the parasitic element 8 is provided;

FIGS. 8A and 8B are cross-sectional views near the hinge part, including the rear cover, wherein FIG. 8A is a A-A cross-sectional view and FIG. 8B is a B-B cross-sectional view;

FIGS. 9A and 9B are views showing a change in current distribution in the housings, wherein FIG. 9A shows current distribution in a case of having no parasitic element and FIG. 9B shows current distribution in another case of having a parasitic element; and FIGS. 10A and 10B are graphs showing results obtained by calculating differences in directivity characteristics depending on presence/absence of a parasitic element, according to a moment method, wherein FIG. 10A shows calculation results in a case of providing no parasitic element and FIG. 10B shows calculation results in another case of providing a parasitic element.

DETAILED DESCRIPTION OF THE PREFERRED EMBODIMENTS

Structure of the Embodiment

Figure 1:
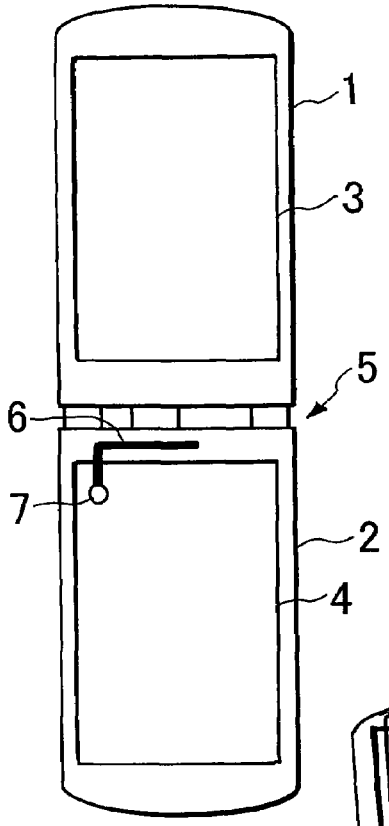
FIG. 1 is a view showing an antenna structure of a mobile wireless terminal which was discussed in the inventive process of the present invention.

FIG. 1 is a view showing an antenna structure of a mobile wireless terminal which was discussed in the inventive process of the present invention. This figure is a perspective diagram viewed from the rear side of the mobile wireless terminal and is constructed by a foldable structure in which an upper housing 1 including a display section and the like and a lower housing 2 including a key operation section and the like can be folded by rotating these housings 2 by a hinge part 5 positioned at ends of the housings. The upper and lower housings 1 and 2 respectively contain upper and lower boards 3 and 4. The boards 3 and 4 are electrically connected by a flexible board which is spirally wound around from insides of the housings through the hinge part 5.

Also, the lower board 4 is provided with a feeding point 7 which supplies a high frequency signal to an antenna element by a wireless circuit. A metal element as an antenna element 6 is provided inside an upper end of the lower housing 2, extending from the feeding point 7. The metal element is like a rod, for example. The metal element extends in the lengthwise direction of the lower housing 2 and is bent in a substantially perpendicular direction inside the upper end of the lower housing 2, thus extending in a direction parallel to the hinge axis. The upper housing 1 is made of an electrically conductive material, and the capacity of an end of the housing 1 in the side of the hinge part 5 and the capacity of the antenna element 6 are coupled. Thus, the structure is arranged to be able to transmit and receive electromagnetic waves by the antenna element 6 itself and the upper housing 1 whose capacity is coupled with that of the antenna element 6.

In the antenna structure of the mobile wireless terminal shown in FIG. 1, the gain in radiation characteristic of a high-frequency signal is not sufficient, and a null characteristic appears in a desired direction. Thus, it is difficult to realize preferable antenna directivity characteristics which are demanded for a mobile wireless terminal.

Figure 2:
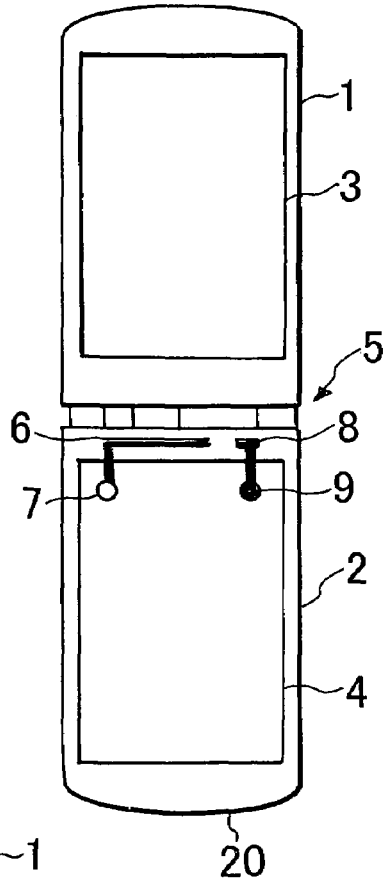
FIG. 2 is a view showing a mobile wireless terminal according to an embodiment of the present invention.

FIG. 2 is a view showing a mobile wireless terminal according to an embodiment of the present invention. This figure is a perspective diagram viewed from the rear side of the mobile wireless terminal. Like FIG. 1, this figure shows an example applied to a foldable mobile wireless terminal constructed in a structure in which upper and lower housings 1 and 2 can be folded by a hinge part 5.

The upper housing 1 forming part of the foldable structure is electrically conductive at least in the front side. The housings respectively have boards 3 and 4. An antenna element 6 is provided near the hinge part 5, on one of the boards, i.e., the circuit board 4. An auxiliary metal fitting is provided, as a parasitic element 8 connected to a ground terminal 9, at a position which is symmetrical with the antenna element 6, on the long edge at an upper end of the lower housing 2. The antenna element 6 and the parasitic element 8 are close to each other at different positions of the upper housing 1.

Figure 3:
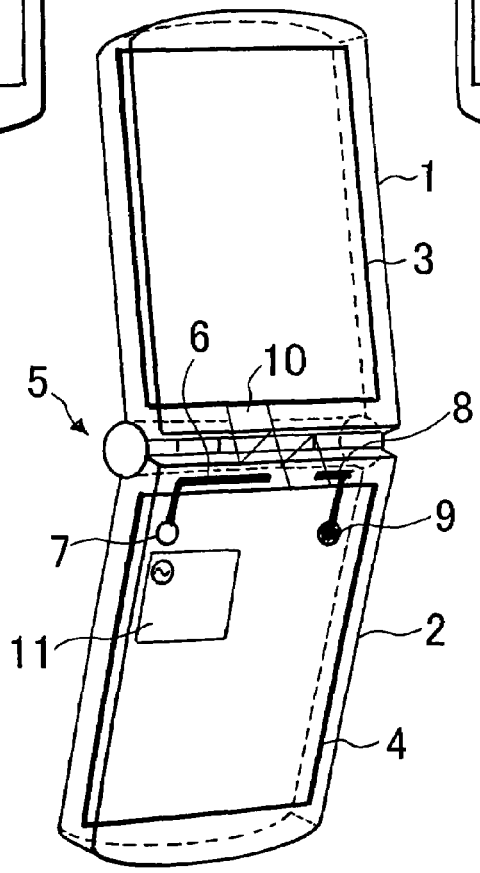
FIG. 3 is a three-dimensional perspective view of the mobile wireless terminal according to the embodiment of the present invention.

FIG. 3 is a three-dimensional perspective view of the mobile wireless terminal according to the present embodiment. The upper housing 1 having a display section and made of electrically conductive material and the lower housing 2 made of insulating material and having a key operating section are constructed in a structure in which these housing are hinged and rotated about a hinge axis by the hinge part 5 positioned at ends of the housings. The upper and lower housings 1 and 2 respectively contain the upper and lower boards 3 and 4. The upper and lower boards 3 and 4 are electrically connected through the hinge part 5 from insides of the housings by a flexible board 10 which is spirally wound.

Also, the lower board 4 is provided with a wireless circuit 11 and a feeding point 7 which supplies a high-frequency signal to the antenna element 6 through the wireless circuit 11. For example, a rod-like metal element as an antenna element 6 extends in the lengthwise direction of the lower housing 2 to the side of the hinge part 5 (the inside of the upper end of the lower housing) from the feeding point 7. In addition, the rod-like metal element is bent substantially at right angles inside the upper end of the lower housing, extends in parallel with the hinge axis, and is positioned to be capacity-coupled by floating capacity with an end of the upper housing made of electrically conductive material, in the side of the hinge part 5.

Further, in the lower board 4, the parasitic element 8 is connected to the ground 9 of the lower board 4. The parasitic element 8 is constituted by, for example, a rod-like metal element and has a structure as follows. That is, the parasitic element 8 extends in the lengthwise direction of the lower housing 2 to the side of the hinge part 5 inside the lower housing 2 from a connection point of the lower board 4, like the antenna element 6. In addition, this element is bent substantially at right angles inside the upper end of the lower housing, and has an end slightly extending in parallel with the hinge axis.

Operation of the Embodiment

Operation and characteristics of the present embodiment will now be described. In the mobile wireless terminals shown in FIGS. 1 and 2, a high-frequency signal supplied from the board 4 to the antenna element 6 flows through the antenna element 6. The antenna element 6 and the electrically conductive upper housing 1 are so close to each other that capacitances of both the antenna element and this housing are coupled together. Therefore, the high-frequency current flows also through the upper housing 1. As a result of this, the antenna element 6 itself radiates an electromagnetic wave, and the upper housing 1 whose capacitance is coupled with the antenna element 6 also radiates an electromagnetic wave. The element 6 and the housing 1, as a whole, work as an antenna having a relatively high radiation efficiency.

Figure 4A:
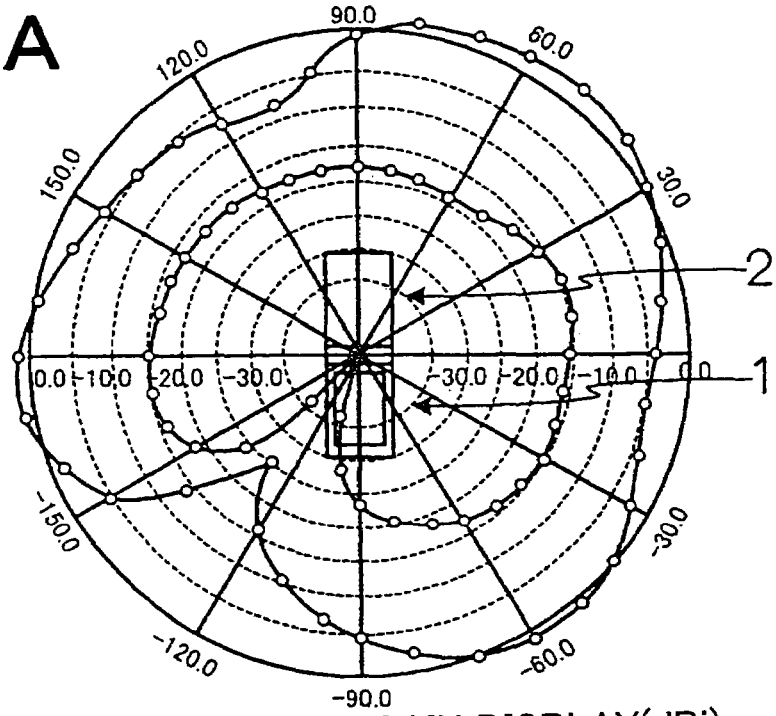
Figure 4B:
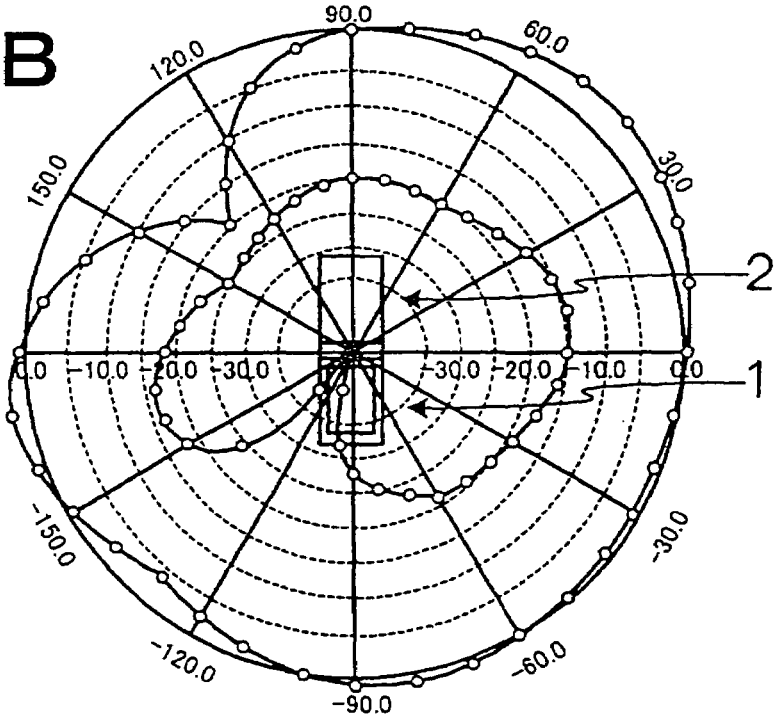

FIGS. 4A and 4B are graphs showing general tendencies of antenna directivity of the mobile wireless terminal shown in FIGS. 1 and 2. FIG. 4A shows directivity of the antenna shown in FIG. 1. FIG. 4B shows directivity of the antenna shown in FIG. 2 (and FIG. 3). In these figures, the inner characteristic curves show directivity of horizontal polarized waves, and the outer characteristic curves show directivity of vertical polarized waves.

In the mobile wireless terminal shown in FIG. 1, when the antenna has directivity in directions toward the downside under the horizontal direction in the side of the upper housing 1, a null characteristic or the like appears, as can be seen from FIG. 4A. This characteristic is extremely inconvenient for a feature of a mobile. wireless terminal because the upper housing 1 is situated in the upside in a usual use state in which the mobile wireless terminal is kept standing, e.g., a telephone conversation with the mobile wireless terminal held on a human head. This characteristic is considered to depend on a factor that the current level of a high-frequency current flowing through the upper housing 1 capacity-coupled with the antenna element 6 decreases in the lateral sides of the antenna element 6 so that a radiation gain of an electromagnetic wave decreases in corresponding directions.

In contrast, the other mobile wireless terminal shown in FIGS. 2 and 3 is constructed such that the parasitic element 9 is provided at a position distant from the antenna element 6, to be capacity-coupled with the upper housing 1, as can be seen from FIG. 4B. Unlike the case of providing the antenna element 6 singly, it is possible to prevent gain reductions caused by the null characteristic and the like. In a use state in which the mobile wireless terminal is held standing, the gain characteristic improves when the directivity is in upward directions above the horizontal direction. This is because the parasitic element 8 consisting of an auxiliary metal fitting is provided at a position opposite to the position where the antenna element 6 is provided thereby to increase the flow of a current in the side of the antenna element 6 in the upper housing 1.

EXAMPLES

Next, practical examples of the mobile wireless terminal according to the present invention will be described in details with reference to FIGS. 5 to 8.

Figure 5A:
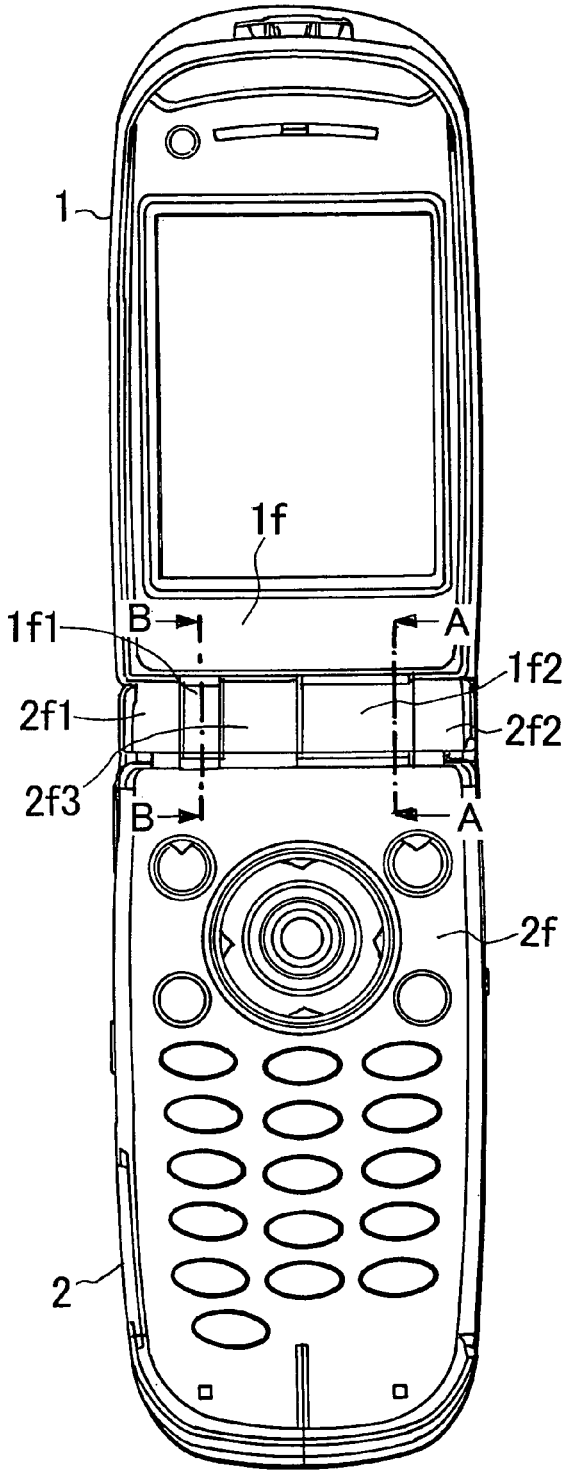
FIGS. 5A and 5B show the front and rear of a mobile wireless terminal according to the embodiment of the present invention.
Figure 5B:
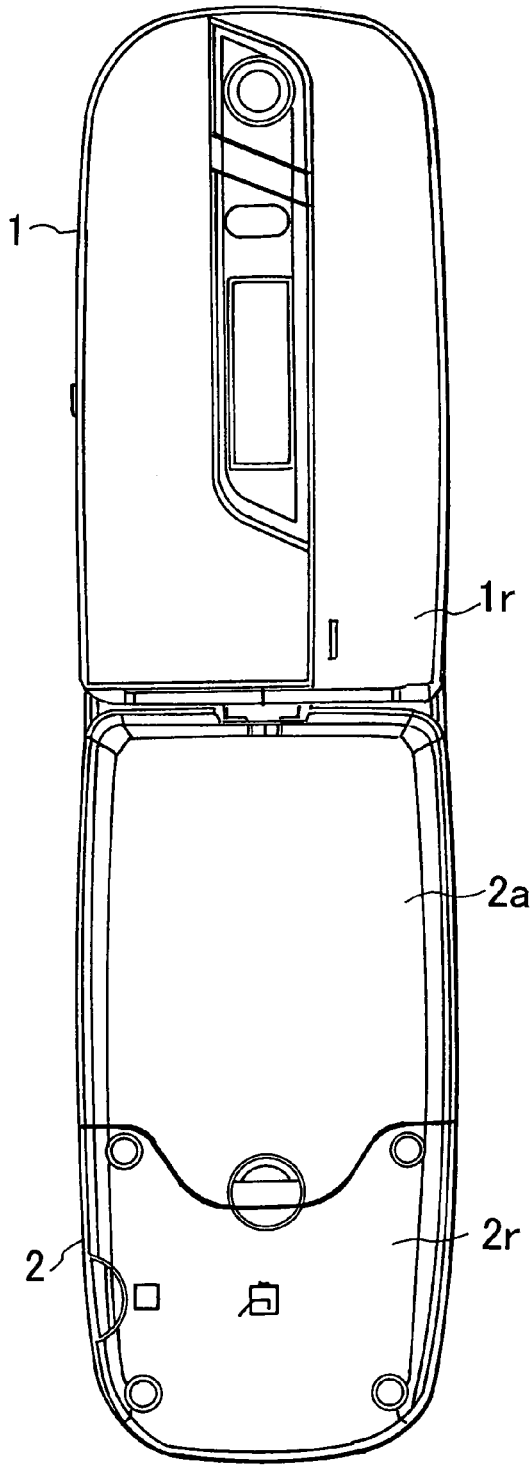
Figure 6:
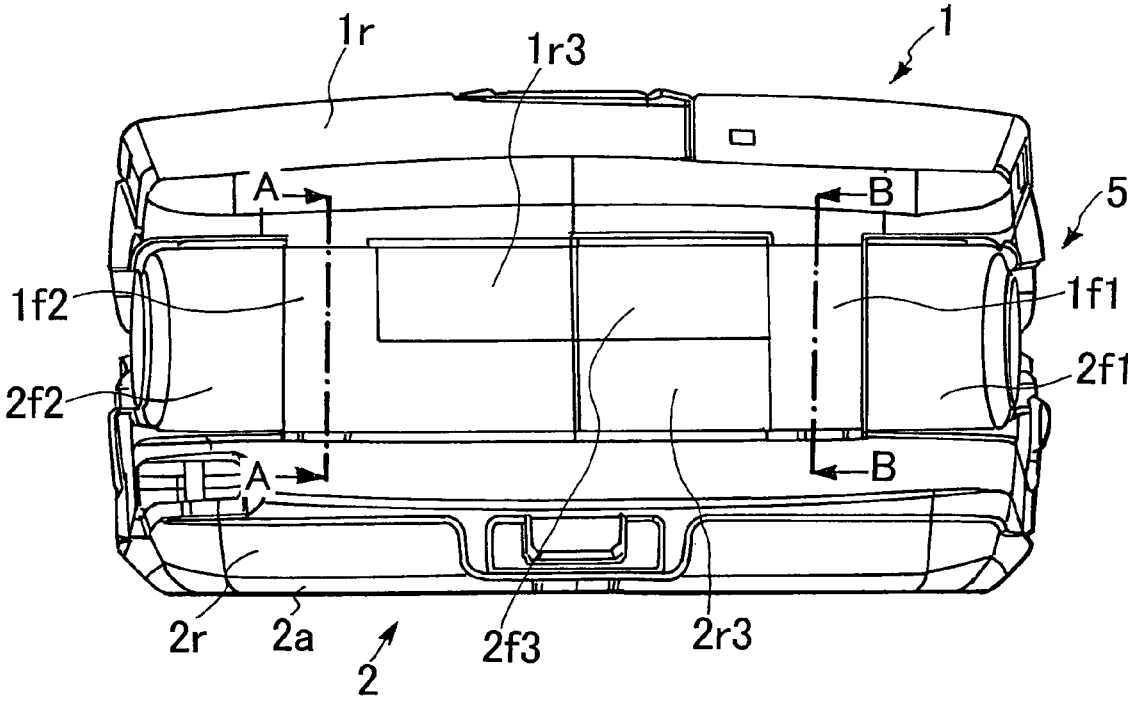
FIG. 6 is a front view of a hinge part of the mobile wireless terminal in a folded state.

FIG. 5 shows the front and rear of a mobile wireless terminal according to the present embodiment. FIG. 6 is a front view of a hinge part of the mobile wireless terminal in a folded state.

The upper housing 1 in this example is constituted by a front cover 1*f* and a rear cover 1*r* engaged with each other. The front cover 1*f* is manufactured by die-casting and made of a metal material. The rear cover 1*r* is made of a non-metal material. Two protrusions (or called cylindrical protrusions) 1*f*1 and 1*f*2 are integrally formed respectively on two lower side ends of the front cover 1*f*, slightly inside the two side ends. The protrusions each have a hinge shaft hole for hinged connection and have a cylindrical cross-section.

The lower housing 2 is constituted by engaging a front cover 2*f* and a rear cover 2*r* both of which are made of a non-metal material. On the upper side of the front cover 2*f*, two cylindrical protrusions 2*f*1 and 2*f*2 each having a hinge shaft hole for hinged connection are formed such that the protrusions 2*f*1 and 2*f*2 are engaged with the former two cylindrical protrusions 1*f*1 and 1*f*2 from both side ends of each of the protrusions 1*f*1 and 1*f*2, and that the protrusions 2*f*1 and 2*f*2 are hinge-connected respectively with the protrusions 1*f*1 and 1*f*2 by different hinge shafts (51 and 52). This example is constructed in a structure in which a container case for a battery (11 described later) is formed at a rear part of the rear cover 2*r* and the rear side of the container case is covered with a cover 2*a*.

Another protrusion 2*f*3 in the center of the lower housing 2 is an arc-like extension from the front cover 2*f*. This protrusion 2*f*3 is engaged with another arc-like extension 2*r*3 provided at the same position on the rear cover 2*r* of the lower housing 2 as the protrusion 2*f*3. Another protrusion 1*r*3 in the center of the rear cover 1*r* of the upper housing 1 is an arc-like extension from the rear cover 1*r*. This protrusion 1*r*3 is engaged with the arc-like extension extended from a side part in the center side of the cylindrical protrusion 1*f*1 of the front cover 1 of the upper housing 1 in a direction toward the center of the protrusion 1*f*1. Although every one of these protrusion appears to form an intermediate part of the hinge part, a cylindrical cavity internally communicating with the inside of the housing is formed inside each of these protrusion. At corresponding portions, a flexible board or the like which electrically connects the boards 3 and 4 to each other is inserted between the upper housings 1 and 2.

Figure 7A:
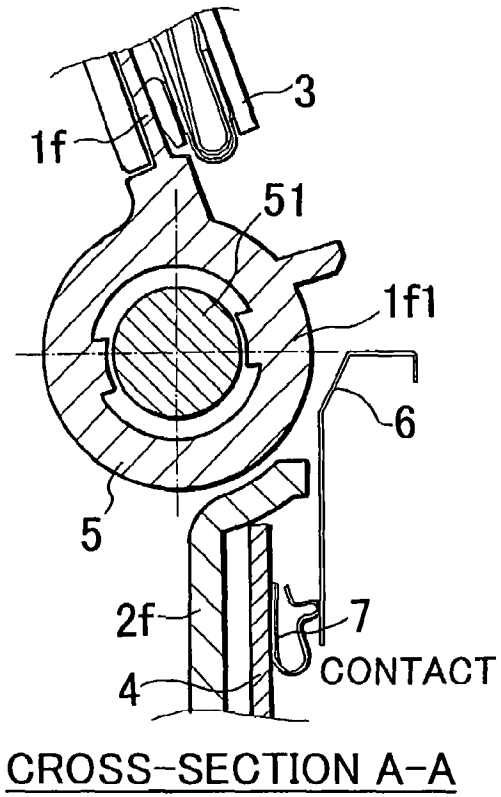
Figure 7C:
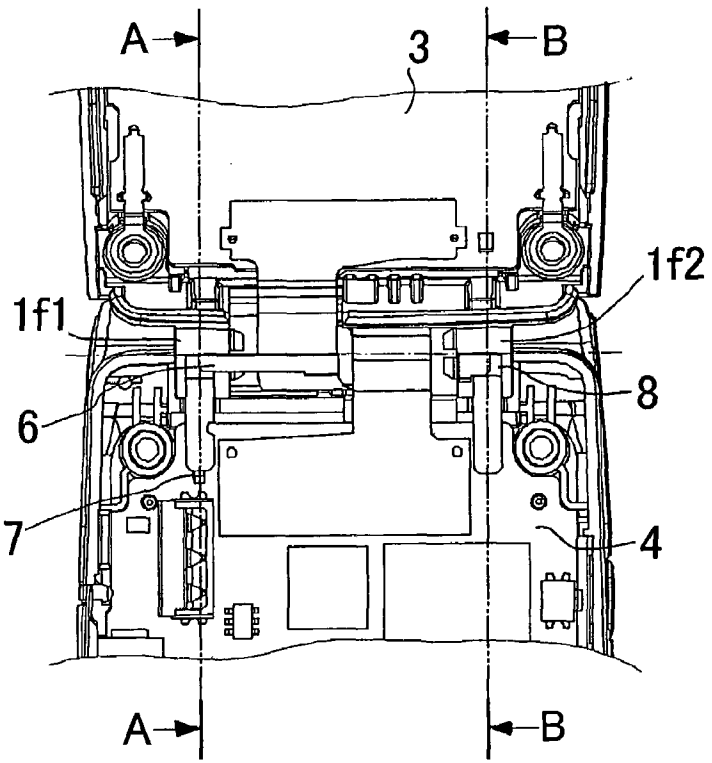
Figure 7B:
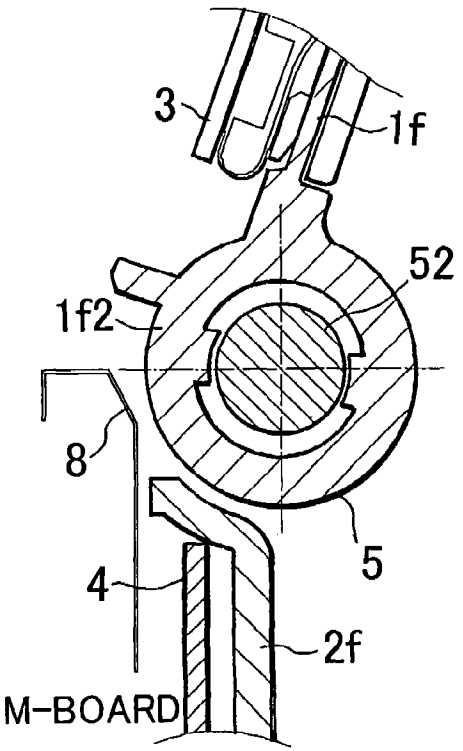

FIGS. 7A to 7C are cross-sections and a rear view in which the rear cover is cut away from a portion including an antenna element and a parasitic element near the hinge part. FIG. 7C is a rear view near the hinge part. FIG. 7A is a (A-A) cross-section at a position where the antenna element is provided. FIG. 7B is a (B-B) cross-section at a position where the parasitic element 8 is provided.

In the structure of the antenna element 6 in this example, a high-frequency signal supplied from a feeding point (e.g., a feeding electrode) mounted in the front cover 2*f* of the lower housing 2 is supplied to an end part of an antenna element 6 made of a substantially L-shaped plate metal through a spring-like contact, as shown in the A-A cross-section. The antenna element 6 is positioned as follows. That is, the antenna element 6 extends in the lengthwise direction of the housing and is slightly inclined near the cylindrical protrusion 1*f*1 of the front cover 1*f* of the upper housing 1.

The antenna element 6 further extends in the hinge axis direction (perpendicular to the paper face).

The structure of the parasitic element 8 is constituted by an auxiliary metal fitting made of a substantially L-shaped plate metal, as shown in the B-B cross section. The parasitic element 8 is fixed with no high-frequency signal supplied to any upper part of the lower board 4 mounted inside the front cover 2*f* of the lower housing 2 (the end part is open and not connected to the ground or the like). The parasitic element 8 extends in the lengthwise direction of the housing and is slightly inclined near the cylindrical protrusion 1*f*2 of the front cover 1*f* of the housing 1. The parasitic element 8 further extends in the hinge axis direction (perpendicular to the paper face).

According to the structure as described above, in the present example, the earth surface of the lower board 4 is used as a ground, and the antenna element 6, the front cover 1*f* of the upper housing 1 which is capacity-coupled with the antenna element 6, and the parasitic element 8 capacity-coupled with the front cover 1*f* of the upper housing serve as an antenna to transmit/receive electric waves.

Figure 8B:
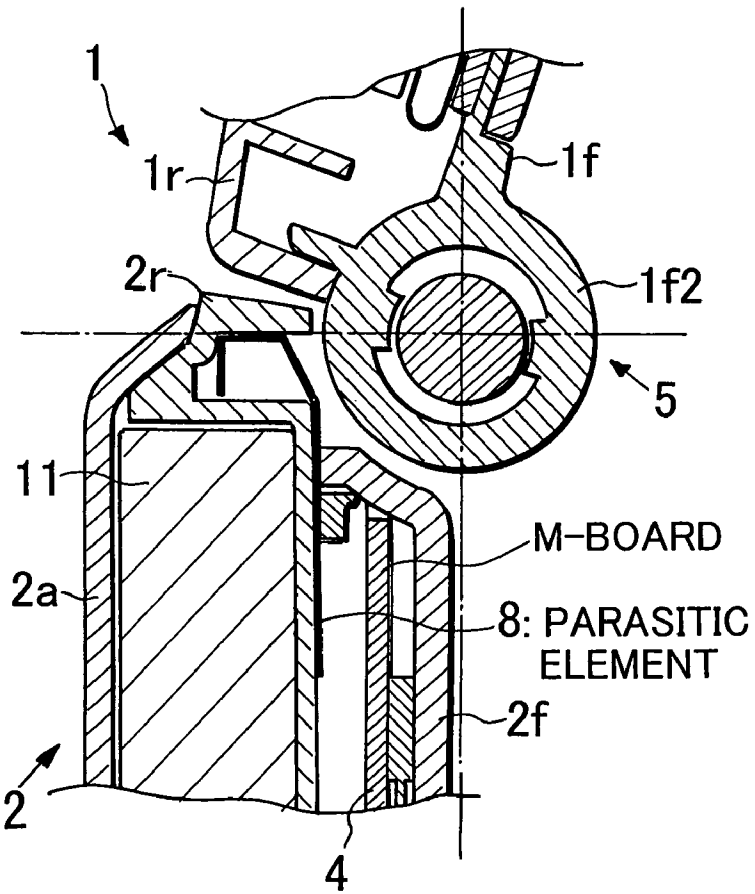
Figure 8A:
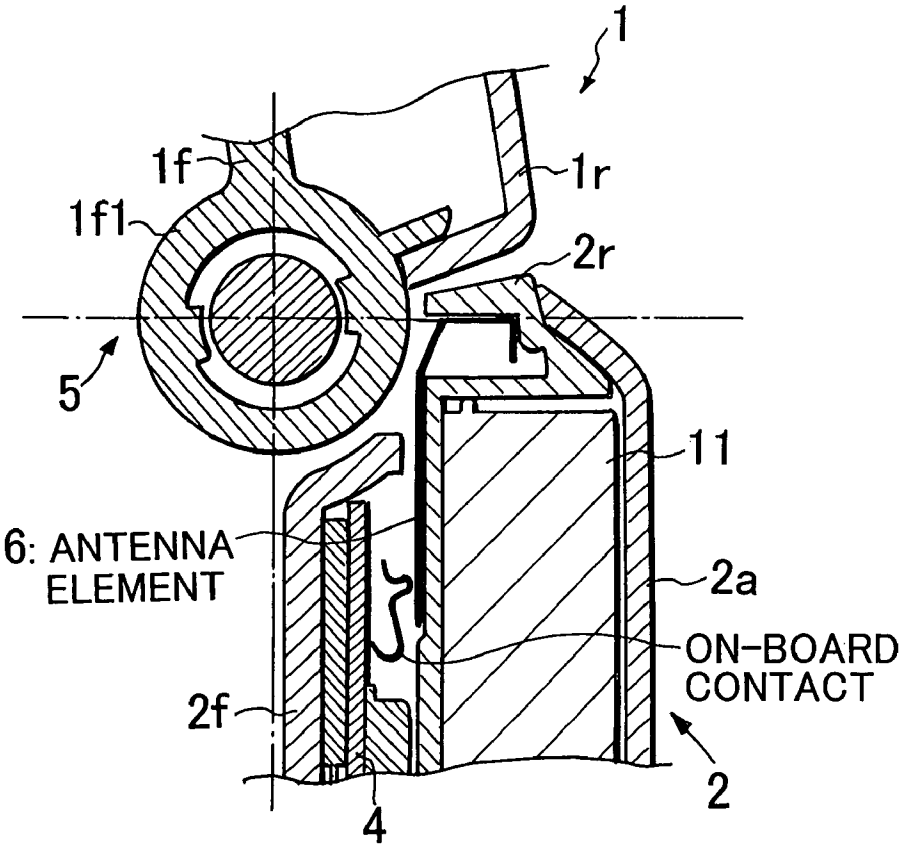

FIGS. 8A and 8B are cross-sectional views near the hinge part, including the rear cover. FIG. 8A is an A-A cross-sectional view, and FIG. 8B is a B-B cross-sectional view. These figures show a mount structure of the antenna element 6 and the parasitic element 8.

The antenna element 6 and the parasitic element 8 are held by the rear cover of the lower housing 2. The rear cover 2*r* of the lower housing 2 has a groove structure in each of both end sides inside side walls of an upper end part in the side of the hinge part. The groove structure is long enough to mount the antenna element 6 and the parasitic element 8. In the groove structures, the antenna element 6 made of an L-shaped plate metal and the parasitic element 8 extend along the inner surface of the rear cover 2*r* in the lengthwise direction of the lower housing 2, and reach the groove structures inside the side walls of the upper end part of the hinge part. To be extendible from this position in the hinge axis direction, the groove structures are formed between the side walls of the upper end part of the rear cover 2*r* and the container case of the battery 11.

Figure 9A:
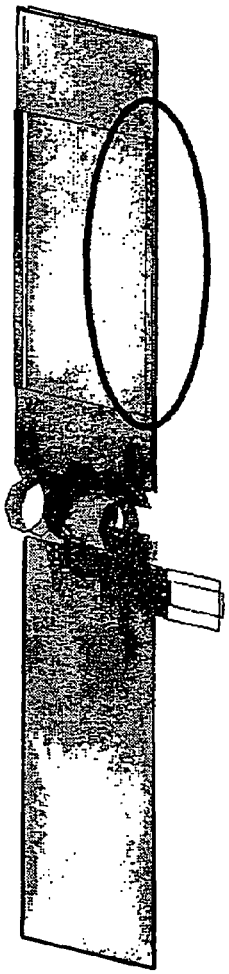
Figure 9A:
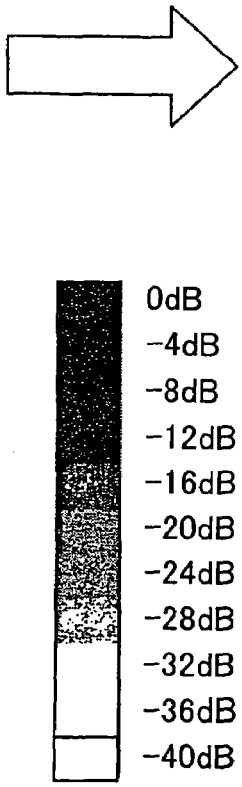
Figure 9B:
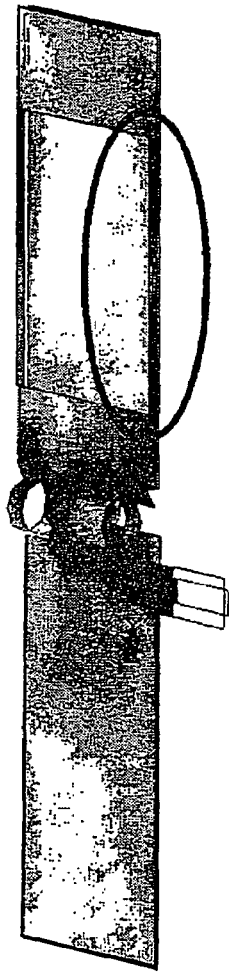

FIGS. 9A and 9B are views showing a change in current distribution in the housings depending on presence/absence of a parasitic element. FIG. 9A shows a case of having no parasitic element. FIG. 9B shows another case of having a parasitic element. In the case where no parasitic element 8 is provided as shown in FIG. 9A, the current decreases in a side part (indicated by a circle) of an opening part for a display section (LCD: Liquid Crystal Display) in the side of the antenna element 6 of the upper housing 1. It can be understood that, by providing the parasitic element 8 according to this example, as shown in FIG. 9B, the current in the side part (indicated by a circle) of the upper housing 1 increases.

Figure 10A:
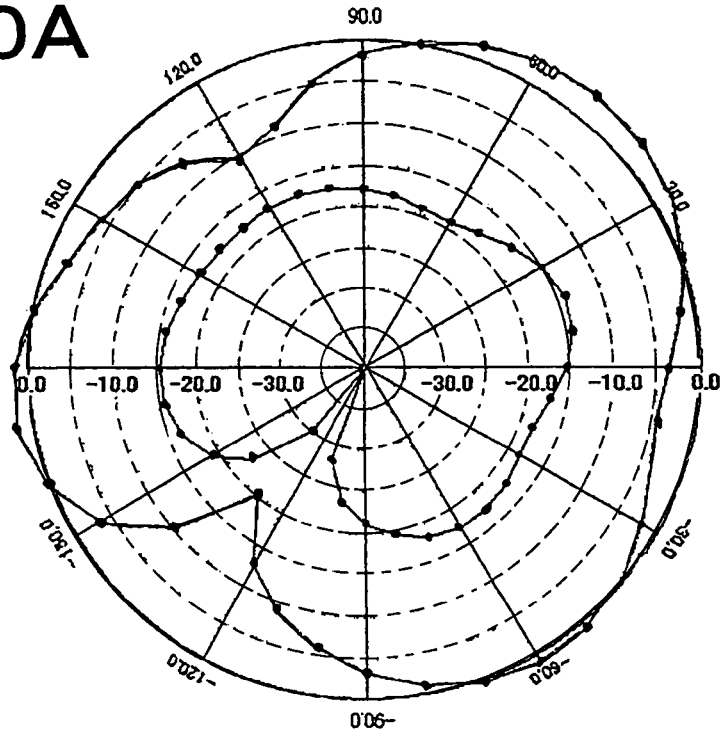
Figure 10B:
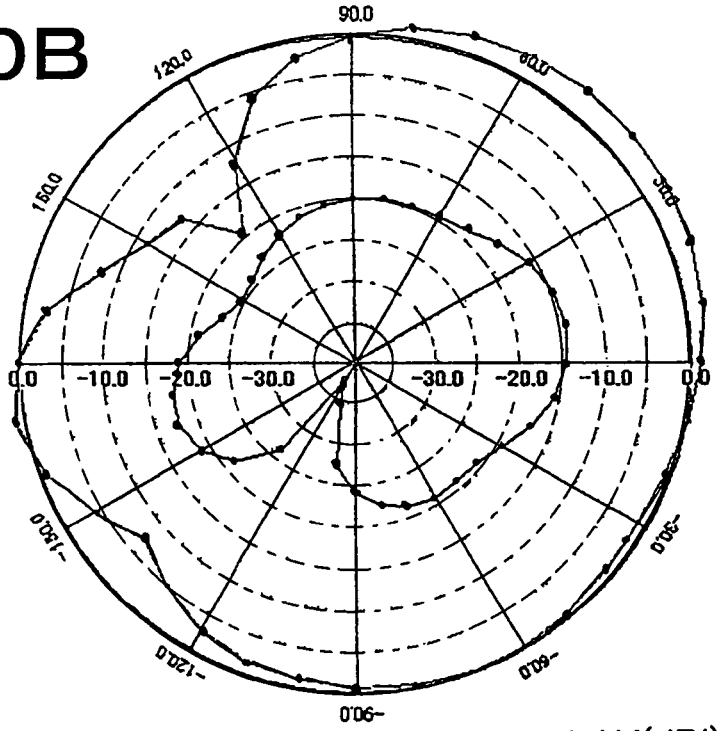

FIGS. 10A and 10B are graphs showing results obtained by calculating differences in directivity characteristics depending on presence/absence of a parasitic element, according to a moment method. FIG. 10A shows calculation results in a case of providing no parasitic element. FIG. 10B shows calculation results in another case of providing a parasitic element. The inner characteristic curves in these graphs show directivity of horizontal polarized waves, and the outer characteristic curves show directivity of vertical polarized waves. As can be seen from these graphs, in a use state of the mobile wireless terminal (in which the upper housing 1 is kept upside), gains in upward directions above the horizontal direction are entirely increased by providing the parasitic element 8, and the directivity is changed so that the null characteristic can be improved with respect to the upside.

That is, the antenna element 6 is provided to approach a protrusion of the upper housing 1 while the parasitic element 8 is provided to approach the other protrusion of the upper housing 1. In this way, the respective elements are capacity-coupled with the upper housing 1 at substantially symmetrical positions. As a result, the current flow on the upper housing 1 can be changed efficiently, and the directivity can also be changed, to improve the antenna characteristics.

Other Embodiments (1) Housing Structure

The embodiment described above shows an example in which the front cover as an electrically conductive upper housing is made of a metal material. Alternatively, if the rear cover is made of a metal material, the present invention can be achieved. Also alternatively, both covers of the upper housing can be made of a metal material. Electrically conductive plating (metal plating) can be applied to the surface of the front cover or the rear cover, or the surfaces of both covers. In this case, metal plating to attain an antenna function need not be applied to the entire of the front or rear surface of the front cover or the rear cover, or the front or rear surfaces of both covers, but there may be a non-plated part. Further, the upper housing having electric conductivity may be constructed to be electrically connected to the earth surface of the circuit board mounted in the upper housing 1.

The lower housing can be nonconductive and can have an antenna structure in which an earth-plated surface of the circuit board in the lower housing is a ground for an antenna element and the like. Alternatively, as a ground structure of the antenna, the front cover or the rear cover of the lower housing can be made of a metal material to become electrically conductive like the upper housing, or can also be a ground for the antenna element and the like by applying metal plating.

(2) Hinge Structure

The structure connecting the upper and lower housings by the hinge part of the mobile wireless terminal according to the present invention is not limited to a foldable structure in which the front covers are connected together by a hinge shaft, as shown in FIGS. 4 and 5. Apparently, the present invention is applicable to an alternative foldable structure in which the front cover of the upper housing and the rear cover of the lower housing, the rear cover of the upper housing and the front cover of the lower housing, or the rear covers of the upper and lower housings are connected by a hinge shaft.

Further, as a mobile wireless terminal of the present invention, it is possible to apply the present invention to a mobile wireless terminal having a connection structure in which: a second axis structure is provided to connect the upper and lower housings such that the upper housing is rotatable relatively to the lower housing about an axis perpendicular to the hinge axis; the upper housing is connected to the lower housing such that the upper housing is rotatable relatively to the lower housing in a direction parallel to the front face of the lower housing; or the upper housing slides to be extendible and retractable relatively to the lower housing in the lengthwise direction or the like. In other words, whatever movable structure the upper housing has relatively to the lower housing, the antenna element and the parasitic element inside the upper end of the lower housing can be capacity-coupled at respective portions with the electrically conductive upper housing and the present invention is applicable, as long as a positional relationship that the upper end side of the lower housing is opposed to lower end side of the upper housing is kept during use for a telephone conversation or the like.

(3) Antenna Structure and Layout

With respect to the antenna structure, examples of use of a rod-like metal element or a plate metal element as an antenna element or a parasitic element have been described. However, the present invention is not limited to this shape or structure but a 0.25-wavelength element, L-shaped element, meander element, helical shape, an inverted-F antenna based on a metal plate element, or the like is applicable as an antenna element. In addition, the parasitic element may adopt the same structure as the antenna element. The antenna element and parasitic element may be constructed as any possible different combination of elements as described above.

In the example of the antenna structure described above, the antenna element and parasitic element are contained in the rear cover of the lower housing. However, these elements may alternatively be constructed to be contained in the front cover of the lower housing, in consideration of the hinge structure and the movable form of the upper and lower housings. Furthermore, the structure can be arranged to contain both elements respectively in the front and rear covers.

If the two cylindrical protrusions of the upper housing are electrically conductive and are respectively capacity-coupled with the antenna element and the parasitic element, the cover which gives electrical conductivity and the cylindrical protrusions need not be constructed in an integrated structure but may be constructed to be independent from each other as long as the cover and the cylindrical protrusions are electrically connected.

Further, the antenna element and the parasitic element of the present invention are not limited to the structure capacity-coupled with the cylindrical protrusions for hinge connection of the upper housing. It is apparent that the hinge part may be made of a nonconductive material and may be constructed to be capacity-coupled directly with the front cover and/or rear cover of the upper housing.

What is claimed is:

1. A mobile wireless terminal comprising:

an upper housing which contains an upper board, the upper housing being electrically conductive;

a lower housing which contains a lower board;

a connection part which connects the upper and lower housings to each other;

an antenna element which is provided in the lower housing; and a parasitic element which is provided in the lower housing, the antenna element and parasitic element being opposed to each other near the connection part such that the antenna element and parasitic element each are capacity-coupled with the upper housing inside the lower housing.

2. The mobile wireless terminal according to claim 1, wherein the connection part is constructed as a hinge part which allows the upper and lower housings to be folded.

3. The mobile wireless terminal according to claim 2, wherein the upper housing is constructed to be rotatable relatively to the lower housing in a direction perpendicular to the hinge axis of the hinge part.

4. The mobile wireless terminal according to claim 2, wherein the antenna element and the parasitic element each are a rod-like element or a metal-plate-like element, have ends opposed to each other in the connection part, and are situated in parallel with the hinge axis of the hinge part.

5. The mobile wireless terminal according to claim 1, wherein the lower housing is constituted by a front cover and rear cover, and the antenna element and parasitic element are provided in the rear cover.

6. The mobile wireless terminal according to claim 1, wherein the upper housing is constituted by a front cover and rear cover, either the front cover or rear cover of the upper housing having two cylindrical protrusions which are hinged to the lower housing.

7. The mobile wireless terminal according to claim 6, wherein at least one of the front cover and rear cover of the upper housing being electrically conductive.

8. The mobile wireless terminal according to claim 7, wherein the two cylindrical protrusions are electrically conductive, and is electrically connected to at least electrically conductive one of the front cover and rear cover of the upper housing.

9. The mobile wireless terminal according to claim 7, wherein the antenna element and the parasitic element are provided at positions near the two cylindrical protrusions, respectively.

10. The mobile wireless terminal according to claim 1, wherein the parasitic element is connected to an earth electrode of the lower board.

11. The mobile wireless terminal according to claim 1, wherein the parasitic element is open to an earth electrode of the lower board.

12. The mobile wireless terminal according to claim 1, wherein the antenna element is constructed as an inverted-F-shaped antenna element or L-shaped antenna element.

13. The mobile wireless terminal according to claim 1, wherein the lower housing is made of a nonconductive material.

14. The mobile wireless terminal according to claim 1, wherein the antenna element and parasitic element each are capacity coupled by floating capacity with the upper housing.

15. The mobile wireless terminal according to claim 1, wherein the upper housing radiates an electromagnetic wave through capacity coupling with the antenna element.

16. The mobile wireless terminal according to claim 1, wherein the parasitic element is an auxiliary metal fitting, which increases the flow of current in the side of the antenna element in the upper housing.

* * * * *